310-334 SR
XR 3,947,644
X 179/110A
X 89466

United Sta[redacted]
Uchikawa

[11] 3,947,644
[45] Mar. 30, 1976

[54] PIEZOELECTRIC-TYPE ELECTROACOUSTIC TRANSDUCER

[75] Inventor: Shoji Uchikawa, Iwaki, Japan

[73] Assignee: Kureha Kagaku Kogyo Kabushiki Kaisha, Tokyo, Japan

[22] Filed: Aug. 18, 1972

[21] Appl. No.: 281,682

[30] Foreign Application Priority Data

Aug. 20, 1971 Japan ..... 46-62889

[52] U.S. Cl. ..... 179/110 A; 310/8.6; 310/9.5; 310/9.6

[51] Int. Cl.[2] ..... H04R 17/00

[58] Field of Search ..... 179/110 A; 310/8.6, 9.5, 310/9.6; 340/10

[56] References Cited

UNITED STATES PATENTS

| | | | |
|---|---|---|---|
| 2,834,952 | 5/1958 | Harris | 310/8.7 |
| 2,895,062 | 7/1959 | Abbott | 179/110 A |
| 3,030,606 | 4/1962 | Harris | 310/8.7 |
| 3,153,156 | 10/1964 | Watlington | 310/8.6 |
| 3,225,226 | 12/1965 | Kawakami | 310/8.6 |
| 3,586,889 | 6/1971 | Kolter | 310/8.6 |
| 3,676,722 | 7/1972 | Schafft | 310/8.3 |
| 3,749,948 | 7/1973 | Morris | 340/10 |
| 3,792,204 | 2/1974 | Murayama et al. | 179/110 A |
| 3,832,580 | 8/1974 | Yamamuro et al. | 179/110 A |

FOREIGN PATENTS OR APPLICATIONS

| | | | |
|---|---|---|---|
| 1,096,095 | 12/1960 | Germany | 310/9.6 |
| 46-4111 | 2/1971 | Japan | 310/8.6 |
| 1,902,849 | 9/1969 | Germany | 310/9.5 |

*Primary Examiner*—Kathleen H. Claffy
*Assistant Examiner*—George G. Stellar
*Attorney, Agent, or Firm*—Sughrue, Rothwell, Mion, Zinn & Macpeak

[57] ABSTRACT

A piezoelectric-type electroacoustic transducer composed of two convex or concave piezoelectric polymer films each having electrodes on both surfaces thereof, said two polymer films being so connected to electric wiring that, when the one of the piezoelectric polymer films elongates by the action of an electric field in one direction, the other shrinks by the action of the same electric field.

7 Claims, 5 Drawing Figures

FIG. 1
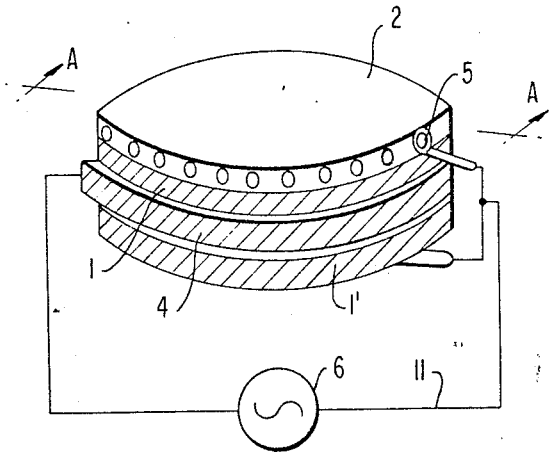
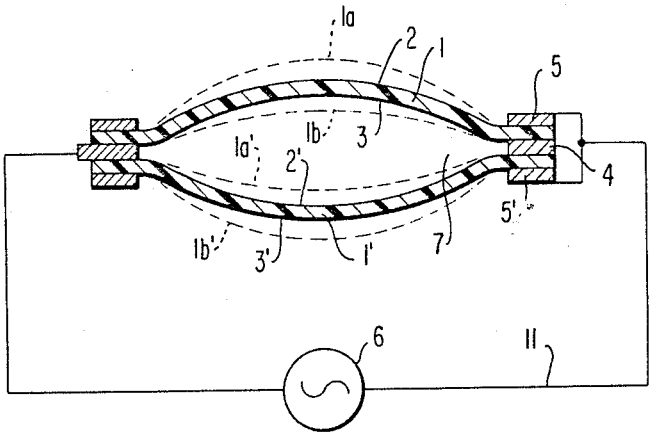
FIG. 2

PIEZOELECTRIC-TYPE ELECTROACOUSTIC TRANSDUCER

BACKGROUND OF THE INVENTION

Field of the Invention

The present invention relates to a novel electroacoustic transducer composed of piezoelectric polymer films, and, more particularly, the invention relates to a novel piezoelectric-type electroacoustic transducer having such a structure that a vibration system comprising two piezoelectric polymer films can receive waves from an electric system and deliver the waves to an acoustic system or can receive waves from an acoustic system and deliver the waves to an electric system.

SUMMARY OF THE INVENTION

An object of this invention is, therefore, to provide a piezoelectric-type electroacoustic transducer comprising piezoelectric polymer films.

Another object of this invention is to provide an improved configuration of piezoelectric polymer films capable of being utilized effectively as an electroacoustic transducer, such as a speaker, a head phone, a receiver, etc.

That is, according to the present invention, there is provided an electroacoustic transducer comprising two piezoelectric polymer films each having electrodes on both surfaces thereof, said polymer films being so disposed that they form convex or concave segments by maintaining the space formed between the two polymer films at a high pressure or a low pressure, respectively, and also each of said polymer films being so connected to an electric circuit that, when the one of the piezoelectric polymer films elongates by the action of an electric current or electric field in one direction, the other of the polymer films shrinks by the action of the same electric current or field. Alternatively, light-weight solids, such as a pumibe stone or polymer foam, may be inserted in the space formed between the two polymer films to provide the convex states of the film instead of maintaining the space at a high pressure.

A piezoelectric film forms an electric field in a direction by the deformation thereof in a direction, and, further, the film is deformed in a direction by the application of an electric field in a direction.

In the following description of this invention, when an electric field in a direction is applied to a piezoelectric polymer film and the side of the film having the electrode provided with positive charges elongates, the side of the polymer film is called the "EN pole or elongation normal pole", and the opposite side of the piezoelectric polymer film is called the "SN pole or shrinkage normal pole".

BRIEF DESCRIPTION OF THE DRAWINGS

FIG. 1 is a perspective view showing an embodiment of this invention.

FIG. 2 is a sectional view of the embodiment of FIG. 1 taken along section line A—A.

DESCRIPTION OF THE PREFERRED EMBODIMENTS

Figure 3:
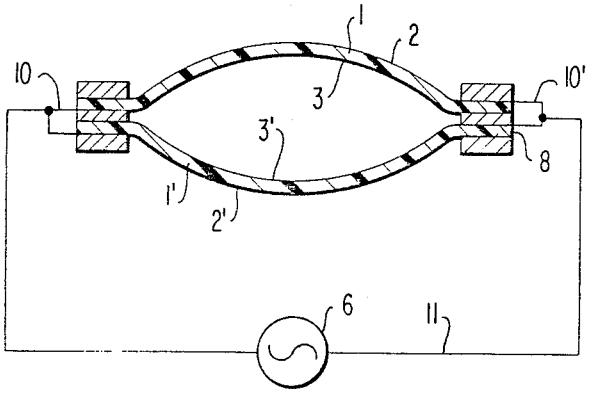
FIG. 3, FIG. 4 and FIG. 5 are sectional views showing other embodiments of this invention.

Now, in FIGS. 1 and 2, piezoelectric polymer films 1 and 1' have on the surface thereof electrodes 2 and 3 and electrodes 2' and 3' respectively. The piezoelectric polymer films are disposed with an intermediate electrically conductive ring 4 (although such a ring is not always necessary in this invention) inserted between the polymer films by tightening up by means of conductive flanges 5 and 5' so that the SN pole 3 of the piezoelectric film 1 faces the EN pole 2' of the polymer film 1', and the polymer films 1 and 1' are placed in their convex states by the pressure of air or a gas enclosed under pressure in the space 7. The assembly of the piezoelectric polymer films is connected to electric wiring 11 for conveying sound current. The numeral 6 indicates a sound frequency electro electric current source.

Now, when the sound current applied to the flanges 5 and 5' becomes positive, the EN pole 2 of the piezoelectric polymer film 1 and the SN pole 3' of the piezoelectric polymer film 1' become positive, i.e., are charged positively and thus the polymer film 1 elongates to the position shown by the dotted line 1*a*, while the film 1' shrinks to the position shown by the dotted line 1*a'*. On the contrary, when the flanges 5 and 5' are charged negatively, the polymer films 1 and 1' are displaced to the position 1*b* and 1*b'*, respectively. Thus, the two piezoelectric polymer films disposed as mentioned above vibrate as a body in response to the change in the sound current.

In the aforesaid embodiment illustrated in FIGS. 1 and 2, the SN pole of the piezoelectric film 1 faces the EN pole of the piezoelectric film 1', but in another embodiment the EN pole (or SN pole) of the one film may face the EN pole (or SN pole) of the other film, as illustrated in FIG. 3. In this case, the two films 1 and 1' are insulated from each other by means of insulative flange 8 so that the EN pole of one film is not electrically connected with the EN pole of the other film. By connecting the assembly of the piezoelectric films to an electric circuit 11 as shown in FIG. 3, the two piezoelectric polymer films 1 and 1' can be vibrated by the same mechanism as in the case of FIGS. 1 and 2.

Figure 4:
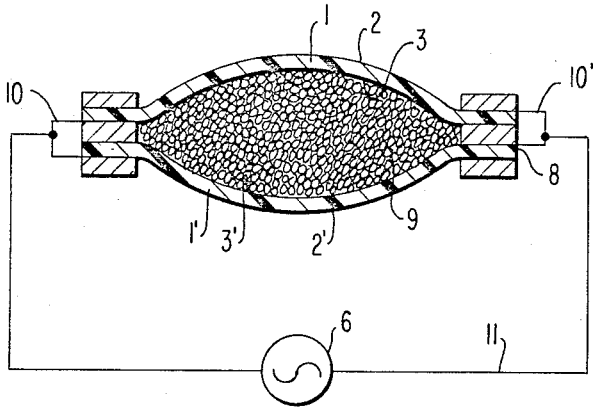

Furthermore, in the embodiment shown in FIG. 4, light-weight solids 9, such as pumice stone or polymer foam, fill the space between the two piezoelectric polymer films 1 and 1' so that the two polymer films are in convex states. In this case, the assembly vibrates as in the case of the embodiment shown in FIGS. 1 and 2. In the embodiment of FIG. 4, the solids 9 do not necessarily fill the whole space between the two polymer films but, for example, they may be present at only the central portions of the space. In the case of inserting such solids in the space between the two polymer films, the space is not necessarily closed as a matter of course.

Figure 5:
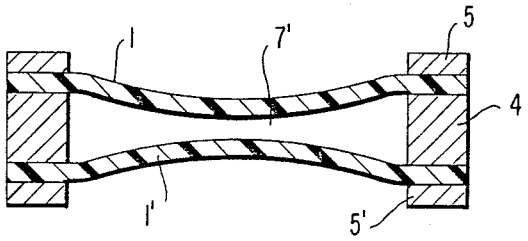

Moreover, in the embodiment shown in FIG. 5, two piezoelectric polymer films 1 and 1' are so disposed by slightly reducing the pressure of the space 7' between the two polymer films that the polymer films are in their concave states. In this case, the piezoelectric films 1 and 1' also vibrate in a body as in the cases indicated above.

As understood from those examples, the electric wiring in which one of two piezoelectric polymer films shrinks when the other film elongates by the action of the same directional electric field is obtained by connecting in parallel the SN-pole of film 1 and the EN-pole of film 2, and the EN-pole of film 1 and the SN-pole of film 2, respectively, so that they have the same voltages, and then by making those two polarities connected in parallel both electrodes of the electroacoustic transducer.

Because the piezoelectric-type electroacoustic transducer of this invention has the structure as mentioned above, by applying an alternating current, such as sound current, to the assembly of the two piezoelectric polymer films, a sound vibration can be effectively obtained directly from the current and further as mentioned above, the oscillator composed of the two piezoelectric polymer films vibrates a body in free space, and thus the efficiency of the electric-sound conversion is quite good.

In the above explanations, the conversion of electricity to sound was explained, but, as with other piezoelectric transducers, the piezoelectric transducer of this invention can be used for converting the vibration of the piezoelectric films to electric change, or a sound-electricity conversion.

EXAMPLE

After subjecting the both surfaces of a diaxially stretched polyvinylidene fluoride film having a thickness of 12 microns to a corona discharging treatment, aluminum was vacuum deposited onto the surfaces to provide aluminum electrodes on both surfaces of the film. Then, a d.c. electric field of 400 kv/cm was applied to both electrodes at 100°C for one hour, and, after cooling the film to room temperature while applying the same electric field, the electric field was removed to provide a piezoelectric polymer film. Two sheets of such piezoelectric polymer films were prepared.

A polyethylene foam was molded into a convex lens having a central thickness of 10 mm and a diameter of 75 mm. The polyethylene foam lens thus molded was placed between the two piezoelectric polyvinylidene fluoride films prepared above, and the periphery of the assembly was supported by two aluminum flanges having an outside diameter of 90 mm and an inside diameter of 80 mm and also an insulative packing made of polyethylene to provide the structure as shown in FIG. 4.

When a sine alternating current of 20 volts was applied between a terminal 10 and a terminal 10' of the assembly as shown in FIG. 4 by means of an oscillator having an output impedance of 600 ohms, sound pressures above 110 db were obtained over a range of 50 Hz to 20 Hz. In addition, the sound pressure was measured by connecting the aforesaid speaker unit and an artificial ear with the ear part of a head phone.

I claim:

1. A piezoelectric-type electroacoustic transducer comprising two piezoelectric polyvinylidene fluoride films each having electrodes on both surfaces thereof, said films being so disposed that they face each other and are stretched into convex states by means of light weight solids inserted in the space between the two films, and said films being so connected to an electric circuit that, when the one of the piezoelectric films elongates by the action of an electric field in a direction, the other of the films shrinks by the action of the same electric field, whereby said films vibrate in phase with said solids.

2. The piezoelectric-type electroacoustic transducer as claimed in claim 1, wherein two different transducer terminals are formed by connecting in parallel each pair of piezoelectric electrodes having different polarities.

3. The piezoelectric-type electroacoustic transducer as claimed in claim 1, wherein said two piezoelectric films are disposed such that different piezoelectric electrodes thereof face each other, both inner electrodes and both outer electrodes thereof being connected, respectively, in parallel.

4. The piezoelectric-type electroacoustic transducer as claimed in claim 1, wherein said two piezoelectric films are disposed such that the piezoelectric electrodes having the same polarity face each other, the inner and outer electrodes of the different films being connected in parallel, respectively.

5. The piezoelectric-type electroacoustic transducer as claimed in claim 1, wherein said light-weight solids are pumice stone or polymer foam.

6. The piezoelectric-type electroacoustic transducer as claimed in claim 1, wherein said light-weight solids are a polymer foam formed in the shape of a convex lens.

7. A piezoelectric-type electroacoustic transducer as defined in claim 1 wherein said light weight solids are non-conductive.

* * * * *